US009765737B2

(12) United States Patent
Kalenborn et al.

(10) Patent No.: US 9,765,737 B2
(45) Date of Patent: Sep. 19, 2017

(54) FUEL INJECTOR

(71) Applicant: L'Orange GmbH, Stuttgart (DE)

(72) Inventors: Markus Kalenborn, Dornstadt (DE); Michael Willmann, Bermatingen (DE); Horst Ressel, Leutenbach (DE)

(73) Assignee: L'ORANGE GMBH, Stuttgart (DE)

( * ) Notice: Subject to any disclaimer, the term of this patent is extended or adjusted under 35 U.S.C. 154(b) by 0 days.

(21) Appl. No.: 14/769,768

(22) PCT Filed: Dec. 13, 2013

(86) PCT No.: PCT/EP2013/003767

§ 371 (c)(1),
(2) Date: Aug. 21, 2015

(87) PCT Pub. No.: WO2014/127794

PCT Pub. Date: Aug. 28, 2014

(65) Prior Publication Data

US 2016/0003204 A1 Jan. 7, 2016

(30) Foreign Application Priority Data

Feb. 22, 2013 (DE) ..... 10 2013 002 969

(51) Int. Cl.
*F02M 47/02* (2006.01)
*F02M 61/04* (2006.01)
*F02M 61/18* (2006.01)

(52) U.S. Cl.
CPC ..... *F02M 47/02* (2013.01); *F02M 61/04* (2013.01); *F02M 61/18* (2013.01); *F02M 2547/008* (2013.01)

(58) Field of Classification Search
CPC .... F02M 47/02; F02M 47/022; F02M 47/025; F02M 47/027; F02M 61/04; F02M 61/18; F02M 2547/008
See application file for complete search history.

(56) References Cited

U.S. PATENT DOCUMENTS 4,344,575 A 8/1982 Seifert
4,442,978 A 4/1984 Seifert
(Continued)

FOREIGN PATENT DOCUMENTS

CN 102003316 A 4/2011
DE 1638929 U 5/1952
(Continued)

*Primary Examiner* — Christopher Kim
(74) *Attorney, Agent, or Firm* — Reising Ethington P.C.

(57) ABSTRACT

Exemplary fuel injectors for use in fuel injection devices are disclosed. An injector may have a control chamber, which can be selectively relieved of pressure by means of a pilot valve in order to control a nozzle needle stroke of an axially displaceable nozzle needle of the injector. The fuel injector may have at least one nozzle on a first end, and the control chamber on a second end of the nozzle needle. The control chamber may be sub-divided by a throttle plate accommodated therein into a first chamber and a second chamber, with the second chamber being positioned closer to the nozzle, and the two chambers communicating with each other via the throttle plate. First and second resilient elements may be accommodated in a pre-stressed manner against the throttle plate in the first chamber and in the second chamber, respectively.

19 Claims, 2 Drawing Sheets

(56) References Cited

U.S. PATENT DOCUMENTS

| | | | | |
|---|---|---|---|---|
| 6,371,441 | B1 | 4/2002 | Mattes | |
| 6,675,773 | B1 * | 1/2004 | Mahr | F02M 45/00 123/446 |
| 9,109,556 | B2 | 8/2015 | Adachi et al. | |
| 2011/0048379 | A1 | 3/2011 | Sommars et al. | |
| 2012/0042852 | A1 | 2/2012 | Yamada et al. | |
| 2012/0152206 | A1 | 6/2012 | Adachi et al. | |

FOREIGN PATENT DOCUMENTS

| | | | |
|---|---|---|---|
| DE | 1026572 | B | 3/1958 |
| DE | 2825982 | A1 | 1/1980 |
| DE | 3342477 | A1 | 1/1985 |
| DE | 3342477 | A1 | 1/1985 |
| DE | 19907348 | A1 | 8/2000 |
| DE | 19907348 | A1 | 8/2000 |
| DE | 102010040316 | A1 | 3/2012 |
| DE | 102010040316 | A1 | 3/2012 |
| DE | 102011056406 | A1 | 6/2012 |
| EP | 1719904 | A1 | 11/2006 |
| EP | 1719904 | A1 | 11/2006 |
| FR | 972143 | A | 1/1951 |
| FR | 994588 | A | 11/1951 |
| GB | 835712 | A | 5/1960 |
| GB | 1433513 | A | 4/1976 |
| JP | 2011208554 | A | 11/2011 |
| WO | WO-03071122 | A1 | 8/2003 |
| WO | 2011122051 | A1 | 10/2011 |
| WO | WO-2013178338 | A1 | 12/2013 |

* cited by examiner

FUEL INJECTOR

CROSS-REFERENCE TO RELATED APPLICATIONS

This application claims priority to German Patent Application No. 10 2013 002 969.4, filed Feb. 22, 2013, and International Patent Application No. PCT/EP2013/003767, filed Dec. 13, 2013, both of which are hereby incorporated by reference in their entirety.

TECHNICAL FIELD

The present disclosure relates to a fuel injector.

BACKGROUND

In the case of fuel injectors, in particular conventional, pilot valve-controlled injectors, which are generally intended for use with diesel fuel, such as, for example, heavy fuel oil or biofuel, it is usually possible to produce a stepped opening ramp in the nozzle needle stroke curve, in particular, with an initially steeper opening ramp section and a subsequently flatter opening ramp section only with considerable complexity in design. However, this feature is desirable for an emission-optimized combustion characteristic when using a fuel injector at a combustion chamber of an internal combustion engine, in particular, a reciprocating piston engine.

SUMMARY

Based on the aforesaid, the object of the present disclosure is to propose a fuel injector, conforming to its genre, which provides a stepped opening stroke, in particular, of the above type in an advantageously uncomplicated way.

This engineering object is achieved, by means of the exemplary illustrations provided herein.

Advantageous further developments and exemplary approaches are also disclosed in the exemplary illustrations herein.

A fuel injector for a fuel injection device is proposed according to an exemplary illustration. The injector can be provided, e.g., for use in a common rail system, where in this case the fuel injector may generally be intended for use with internal combustion engines in the form of gasoline engines or diesel engines, in particular, large diesel engines, and, furthermore, in particular, vehicle engines, for example, in off-road or ship applications, in addition, also in stationary applications, for example, engine-based cogeneration plants.

The fuel injector may comprise a control chamber, which can be selectively relieved of pressure by means of a pilot valve (e.g., a servo valve or more specifically control valve) of the injector, in order to control the nozzle needle stroke of an axially displaceable nozzle needle of the injector (indirectly controlled injector). In one example, at least one nozzle is formed on the first end of the nozzle needle; and the control chamber of each fuel injector is formed on a second end of the nozzle needle.

An exemplary fuel injector may be characterized in that the control chamber is subdivided by a throttle plate, accommodated therein, into a first chamber, which is further away from the nozzle, and a second chamber, which is closer to the nozzle, said chambers communicating with each other by means of the throttle plate, wherein a first resilient element and a second resilient element are each accommodated in a pre-stressed manner against the throttle plate in the first chamber and in the second chamber respectively, said resilient elements bear in an axially displaceable manner the throttle plate, and wherein a high pressure inflow line into the control chamber and a relief outflow line out of the control chamber lead into and out of the first chamber respectively. In this example, the throttle plate is arranged between the first and second resilient element and, in so far, may be arranged in a sandwich arrangement.

The proposed injector is inexpensive and can be easily produced with very little design complexity and lends itself to the objective of achieving reliably the intended gradation in the opening ramp at the beginning of the injection process, i.e. before the nozzle needle goes into the end stop, in particular with the intended steep initial ramp portion immediately after the start of the opening and with the subsequently flatter opening ramp portion before the nozzle needle is in the end stop. Furthermore, it is also possible in this case to produce a fast closing ramp.

In some exemplary illustrations, it is provided for this purpose that the second resilient element has a spring constant greater than or equal to the spring constant of the first resilient element. In particular, when the spring constants are the same, the pre-stress distance tolerances may advantageously have only a negligible effect on the relative rest position of the throttle plate after installation.

In addition, the spring constants can be selected, for example, in such a way that the stiffness of the second resilient element is 1 to 4 times the stiffness of the first resilient element. This feature can help to prevent the nozzle needle from coming too close to the throttle plate in the steep first opening ramp section.

In order to keep the length of the initial opening ramp phase in the injection rate profile short, the spring length of the first resilient element may be selected to be shorter than that of the second resilient element. The same applies to the reverse case.

The throttle plate may be formed, for example, as the plate member, with or more specifically by means of at least one restrictor bore, which extends axially through the throttle plate as a through opening. For example, a restrictor bore extends centrally through the throttle plate. In general, the throttle plate may be formed in the shape of a disk (extending radially flat), where in this case the throttle plate may have an H shaped cross section, merely as an example.

In the H shaped configuration the crossbar of the H shape may extend, in particular, radially. The throttle plate, which is formed in this way, allows the guide to be optimized on the periphery, i.e. at the wall of the control chamber (for example, while providing a sliding seal), where, in addition, the throttle plate also can also prevent in an advantageous way the springs, which are accommodated in the chambers, from being overstressed when said springs are being compressed, due to the fact that the throttle plate acts simultaneously as the space-retaining stop element.

In the case of the throttle plate that is formed in the shape of an H in the cross section, at least one axial restrictor bore may extend through the crossbar of the H shape, in particular, also all of said restrictor bores.

In general, an objective of the present disclosure is to achieve that a fluid communication between the first chamber and the second chamber (in the control chamber) can occur exclusively by means of the throttle plate, in particular by means of the at least one restrictor bore of the same.

The opening characteristic about the fact that the relief outflow line has an outflow restrictor cross section that is larger than the restrictor cross section of the throttle plate, i.e., the restrictor bore(s) thereof, may be adjusted at the fuel injector. Based on the $Q_{100}$ flow values (at 100 bar), the ratio of the restrictor cross section of the throttle plate to the outflow restrictor cross section may be, for example, in a range of 0.12 to 0.4; and/or, based on the $Q_{100}$ flow values (at 100 bar), the ratio of the inflow restrictor cross section (ZDr) of the high pressure inflow line to the outflow restrictor cross section (ADr) may be in a range of 0.5 to 0.9.

Exemplary fuel injectors can be used advantageously with a fuel injection device, for example, in a common rail system. In this respect a fuel injection device, which comprises at least one fuel injector as described above, is also proposed.

Additional features and advantages of the exemplary illustrations will become apparent from the following description with reference to the figures of the drawings, which show the details that are essential to the exemplary illustrations, and also from the claims. The individual features can be realized either individually or collectively in any arbitrary combination in a variant of the exemplary illustrations.

BRIEF DESCRIPTION OF THE DRAWINGS

Some exemplary illustrations are explained in detail below with reference to the accompanying drawings. The drawings show in.

DETAILED DESCRIPTION

Figure 1:
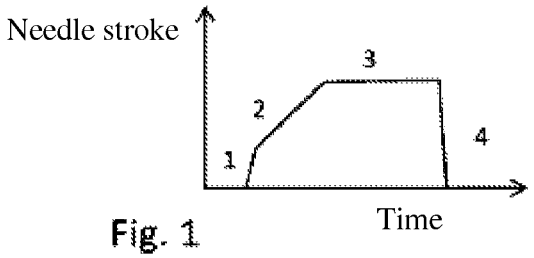
FIG. 1 by way of an example and in schematic form a needle stroke curve, which can be achieved with the fuel injector, during an injection process, according to an exemplary approach.

In the following description and drawings the identical reference numerals correspond to elements having the same function or a comparable function.

FIG. 1 shows in schematic form and by way of an example an intended curve of a needle stroke over time, as it can be achieved in an advantageous and simple way with the proposed fuel injector 10. The curve of the needle stroke may have a steep opening ramp section 1 immediately after the start of the injection process and an adjoining flatter opening ramp section 2. The subsequent section 3 in the needle stroke curve occurs as soon as the nozzle needle 12 reaches the end stop (full stroke position); the closing ramp 4 occurs upon a subsequent closing movement of the nozzle needle 12.

Figure 2:
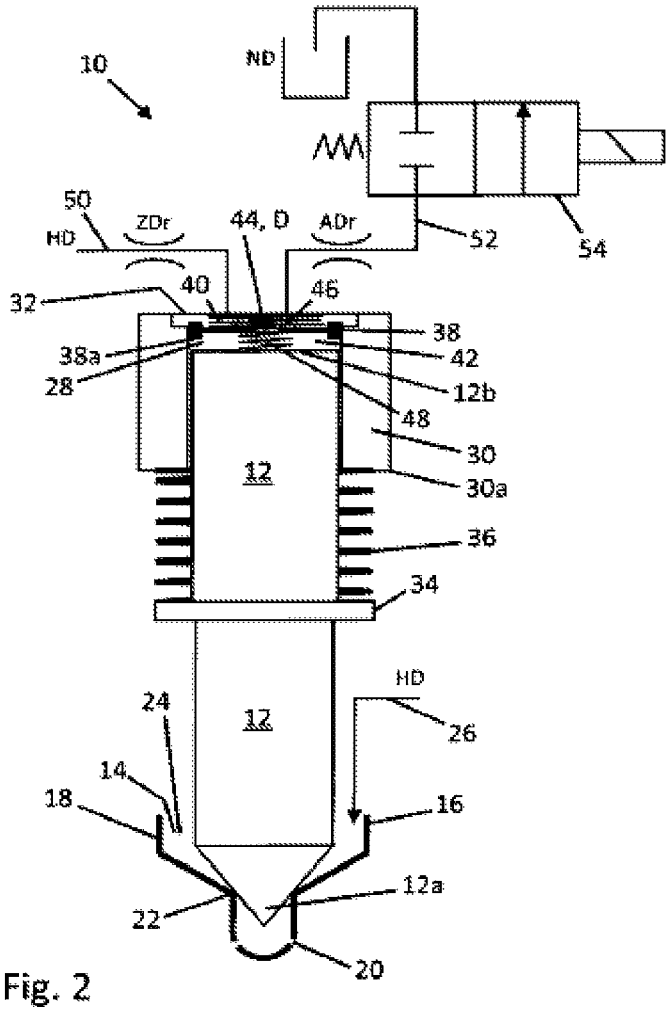
FIG. 2 by way of an example and in schematic form a simplified structure diagram of the fuel injector with the fuel paths, guided along said fuel injector, according to an exemplary illustration.

FIG. 2 shows the exemplary fuel injector 10 in more detail (simplified). In this case the fuel injector is intended for use with a fuel injection device. The fuel injector 10 may be used with diesel fuel, for example, in a common rail system.

The injector 10 has an axially displaceable nozzle needle 12, which is accommodated in an axial bore 14, which is formed in a nozzle body 16 of the fuel injector 10. The nozzle body 16 forms, for example, a part of an injector housing 18.

A nozzle (arrangement) 20 (one or more injection ports), through which high pressurized fuel flows as a function of the needle stroke, is formed on a first end 12*a* of the nozzle needle 12.

When the nozzle needle 12 is displaced axially out of the position (opening stroke), shown in FIG. 2, in which the nozzle needle 12 rests with the first end 12*a* in sealing contact against a valve seat 22, a fuel flow path is opened out of a volume 24 (axial bore 14) upstream of the nozzle valve, which is formed by means of the nozzle needle 12 and the valve seat 22, towards the nozzle 18.

In an injection process, the high pressurized fuel that is to be discharged can be conveyed through a high pressure feed line 26 of the fuel injector 10 into the volume 24. The volume 24 may be formed, as shown in FIG. 2, by means of the axial bore 14, in which the high pressure feed line 24 opens, as an alternative, for example, in the form of a separate high pressure chamber upstream of the nozzle 20 that communicates with the nozzle 20 after the nozzle needle has been opened.

If the nozzle needle 12 returns into the closed position (zero stroke position), the flow path to the nozzle 20 is closed.

Furthermore, the fuel injector 10 comprises a control chamber 28, which is provided on the upper end or more specifically the nozzle distal end 12*b* of the nozzle needle 12. The control chamber 28 is formed by means of a needle guide sleeve 30, into which the nozzle needle 12 dips sealingly with its nozzle distal end 12*b* on the periphery (affected by leakage). Furthermore, in order to form the control chamber 28, the fuel injector 10 comprises a covering element 32 on the nozzle distal end of the guide sleeve 30, where in this case said covering element is provided, for example, as a valve plate 32, in particular, in the injector housing 18.

Furthermore, a nozzle spring 36, which pushes the nozzle needle 12 into the closed position, is caught between the nozzle proximal end 30*a* of the guide sleeve 30 and an annular collar 34 on the nozzle needle 12.

According to one exemplary illustration, a throttling element or more specifically a throttle plate 38 is accommodated in the control chamber 28 (see, for example, FIGS. 2 and 3) in such a way that the control chamber 28 is subdivided into a first chamber 40, which is further away from the nozzle, and a second chamber 42, which is closer to the nozzle. The chambers 40, 42 communicate with each other by means of the throttle plate 38 (where in this case the first chamber 40 and the second chamber 42 have, in particular, volumes that vary as a function of an axial displacement position of the throttle plate 38).

The throttle plate 38, which in the present example has the shape of a (circular) disk and corresponds to the cross section of the control chamber 28, extends (with, for example, an H shaped cross section) radially between the end section 12*b* of the nozzle needle 12 and the covering element 32 (where in this case the crossbar of the H shape extends in the radial direction), in particular, plane parallel thereto. On the periphery the throttle plate 38 is guided (in such a way that it provides a sliding seal), for example by means of the longitudinal legs of an H shaped cross section on the wall 28*a* of the control chamber 28, generally by way of the peripheral wall of the throttle plate 38.

Figure 3:
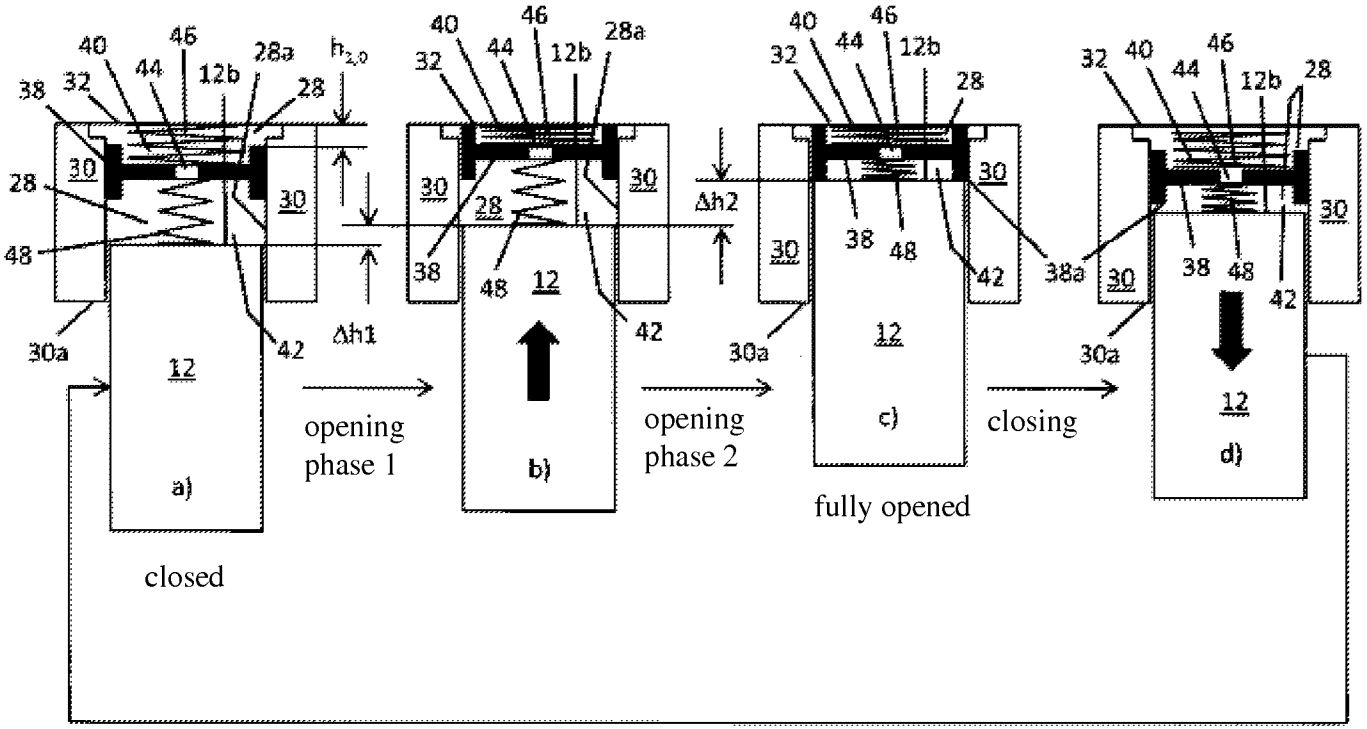
FIG. 3 by way of an example and in schematic form a simplified view for the purpose of illustrating the functionality of an injector, according to an exemplary illustration.

A restrictor bore 44, which passes axially through the throttle plate, may be formed, for example, centrally in the throttle plate 38, (as an alternative, for example, a plurality of restrictor bores 44), which form and/or forms a throttle with a cross section D (see, for example, FIG. 2 or 3). In the exemplary H shape solution described above, one such restrictor bore 44 each may extend through the respective disk shaped crossbar of the H shape, in particular, also all of said restrictor bores.

Furthermore, the fuel injector 10 may also be designed in such a way that a fluid communication between the chambers 40, 42 can take place exclusively by means of the throttle plate 38, i.e., by means of the at least one restrictor bore 44 or more specifically the cross section D thereof.

According to one exemplary illustration, a first resilient element 46, in particular, in the form of a helical compression spring (as an alternative, for example, in the form of a corrugated spring washer or, for example, a cup spring) is accommodated in a pre-stressed manner against the throttle plate 38 in the first chamber 40; and a second resilient element 48, in particular, again in the form of a helical compression spring (as an alternative, for example, again in the form of a corrugated spring washer or, for example, a cup spring) is accommodated in a pre-stressed manner against the throttle plate 38 in the second chamber 42. The first helical compression spring 46 is pushed in a varying manner against the covering element 32; and the second helical compression spring 48 is pushed against the end 12*b* of the nozzle needle 12.

The resilient elements 46, 48 may bear in an axial displaceable manner the throttle plate 38 in the control chamber 28; and in this respect said throttle plate is held in suspension.

It can be seen, for example, in FIG. 2 that, furthermore, the fuel injector 10 is designed, according to one example, in such a manner that a (fuel) high pressure inflow line 50, in particular, with an inflow restrictor cross section ZDr, into the control chamber 28 and a relief outflow line 52, in particular, with an outflow restrictor cross section ADr, out of the control chamber 28 lead into or out of the first chamber 40 respectively.

In order to control the needle stroke by means of a selective relief of the pressure in the control chamber 28, the fuel injector 10 may have, furthermore, a pilot valve (control valve) 54, which may be provided as magnet actuated valve, as an alternative, for example, as a piezoelectric valve. The pilot valve 54 may be a simple and/or fast acting 2/2 way valve, in addition, for example, also a 3/2 way valve. The relief outflow line 52 can be selectively blocked or released in the direction of the low pressure side (Leakage; ND) by means of the pilot valve 54 at the injector 10.

With the fuel injector 10, which may be designed in this way according to the exemplary illustrations and in which the first resilient element 46 may have a smaller spring constant or a spring constant that is equal to that of the second resilient element 48, and/or in which the outflow restrictor cross section ADr is (significantly) larger than the restrictor cross section D of the restrictor bore(s) 44, the intended needle stroke curve may be achieved in the course of an injection process. This feature will be explained below in more detail with reference to FIG. 3.

In a first operating state (before the start of an injection process; zero stroke position of the nozzle needle 12) of the fuel injector 10, shown by a) in FIG. 3, the relief outflow line 52 out of the control chamber 28 to the low pressure side ND, said relief outflow line being guided by means of the throttle ADr, is blocked by means of the pilot valve 54, which is switched into a blocking position. The high pressure inflow line 50 to the control chamber 28 charges the control chamber 28 by means of the high pressurized fuel. In this closed position the throttle plate 38 is held between the resilient elements 46, 48 at an axial distance from both the valve plate 32 and the nozzle needle end 12*a*, in particular, is held in suspension. From the covering element 32 a distance $h_{1,0}$ is set, and from the end 12*a* of the nozzle needle 12 a distance Δh2 is set.

If at this point the control chamber 28 is relieved of pressure by opening the pilot valve 54, see b) in FIG. 3), so that the equilibrium of the closing forces at the needle 12 is cancelled, then the nozzle needle 12 may shift axially with the throttle plate 38 towards the nozzle distal end of the control chamber 28 at the same (or at just slightly less) speed, until the throttle plate 38 strikes against the covering element 32 (as a result of which, the opening phase 1 is completed). In this case the resilient element 48 is not compressed during the opening phase 1 (or compared with the resilient element 46 only slightly compressed). During this opening phase 1, the distance $h_{1,0}$ is taken up by means of the throttle plate 38.

The first opening phase 1 (steeper needle stroke opening ramp section 1 in FIG. 1) is followed by the slower opening phase 2 (flatter needle stroke ramp section 2 in FIG. 1), in which the volume of the second chamber 42 flows through the throttle (D) (which is smaller than ADR) into the throttle plate 38, where in this case a higher resistance prevails. The second opening phase 2 ends, when following compression of the second resilient element 48 the nozzle needle 12 strikes with the end section 12*a* against the nozzle proximal end 38*a* of the throttle plate 38 (full stroke position of the nozzle needle 12). During this opening phase 2 the additional distance Δh2 is consumed.

When the nozzle needle 12 closes, shown by d) in FIG. 3), the pilot valve 54 is first closed, whereupon the pressure in the control chamber 28 rises again. The needle 12 starts to move downward again. Due to the high pressure in the first chamber 40, the throttle plate 38 still remains initially at the nozzle needle 12 (12*a*), i.e. adheres to the same. The throttle plate 38 moves only slowly away from the nozzle needle 12, in so far as the fuel follows, flowing only slowly through the restrictor 44 (D) of the throttle plate 38. During this phase the resilient element 46 can also relax.

As soon as the nozzle needle 12 has come to rest against the valve seat 22, the throttle plate 38 returns again into its starting position, shown by a) in FIG. 3. The duration of the opening ramp 1 is adjusted at the fuel injector 10 by way of the level $h_1$, the rest state.

Based on the $Q_{100}$ values at 100 bar, the ratio of the restrictor cross section D of the throttle plate 38 to the outflow restrictor cross section ADr may be, for example, in a range of 0.12 to 0.4; and/or, based on the $Q_{100}$ values at 100 bar, the ratio of the restrictor cross section of the inflow restrictor line ZDr to the outflow restrictor cross section ADr is in a range of 0.5 to 0.9.

Especially if the spring constants of the first resilient element 46 and the second resilient element 48 are selected to be equal, the ratio of the spring lengths after installation is independent of the sum of the spring lengths, so that it may be easier to synchronize a plurality of fuel injectors 10 of an injection system.

The exemplary illustrations are not limited to the previously described examples. Rather, a plurality of variants and modifications are possible, which also make use of the ideas of the exemplary illustrations and therefore fall within the protective scope. Accordingly, it is to be understood that the above description is intended to be illustrative and not restrictive.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain examples, and should in no way be construed so as to limit the claimed invention.

Accordingly, it is to be understood that the above description is intended to be illustrative and not restrictive. Many examples and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

The invention claimed is:

1. A fuel injector, comprising:

a control chamber;

a pilot valve in fluid communication with the control chamber such that the pilot valve is configured to selectively relieve pressure of the control chamber in order to control a nozzle needle stroke of an axially displaceable nozzle needle of the injector; and at least one nozzle on a first end of the nozzle needle and wherein the fuel injector has the control chamber on a second end of the nozzle needle;

wherein the control chamber is subdivided by a throttle plate, accommodated therein, into a first chamber, and a second chamber which is closer to the nozzle than the first chamber, said chambers communicating with each other via the throttle plate;

wherein a first resilient element and a second resilient element are each accommodated in a pre-stressed manner against the throttle plate in the first chamber and in the second chamber, respectively, said first and second resilient elements bear in an axially displaceable manner upon the throttle plate such that the throttle plate is axially displaceable within the control chamber, the first and second resilient elements positioned on opposing sides of the throttle plate and imparting respective first and second spring forces upon the throttle plate when the nozzle needle is in a closed position, thereby spacing first and second ends of the throttle plate away from a first contact surface of the control chamber and a second contact surface of the nozzle needle, respectively, wherein the first and second ends of the throttle plate are on opposing sides of the throttle plate, and wherein during an opening stroke of the nozzle needle one of the first and second ends of the throttle plate directly contacts its respective contact surface while the other of the first and second ends of the throttle plate is spaced away from its respective contact surface, thereby increasing an effective spring constant imparted by the first and second resilient elements on the nozzle needle; and wherein a high pressure inflow line into the control chamber and a relief outflow line out of the control chamber lead into and out of the first chamber respectively.

2. The fuel injector as recited by claim 1, wherein the second resilient element has a spring constant that is one of greater than and equal to that of the first resilient element.

3. The fuel injector recited by claim 1, wherein the throttle plate has at least one restrictor bore, which extends axially through the throttle plate as a through opening in communication with the first and second chamber.

4. The fuel injector as recited by claim 1, wherein the throttle plate is guided peripherally on a wall of the control chamber, and the throttle plate rests peripherally against the wall of the control chamber in a sliding manner so as to seal.

5. The fuel injector as recited by claim 1, wherein the throttle plate has an H shaped cross section.

6. The fuel injector as recited by claim 1, wherein the throttle plate has an H shaped cross section, wherein at least one axial restrictor bore in the throttle plate extends through the crossbar of the H shape.

7. The fuel injector as recited by claim 6, wherein at least a second restrictor bore is defined by the throttle plate, and all of said restrictor bores in the throttle plate extend through the crossbar of the H-shape.

8. The fuel injector as recited by claim 1, wherein a fluid communication between the chambers is permitted exclusively via at least one restrictor bore of the throttle plate.

9. The fuel injector, as recited by claim 1, wherein the first and the second resilient elements and the throttle plate are configured to adjust a needle stroke curve while the injector is working, the needle stroke curve having a two stage opening ramp.

10. The fuel injector, as recited by claim 1, wherein the relief outflow line has an outflow restrictor cross section, which is larger than a restrictor cross section of the throttle plate.

11. The fuel injector, as recited by claim 1, wherein a ratio of a restrictor cross section of the throttle plate to an outflow restrictor cross section in the relief outflow line is in a range of 0.12 to 0.4.

12. The fuel injector as recited by claim 1, wherein a ratio of an inflow restrictor cross section of the high pressure inflow line to an outflow restrictor cross section is in a range of 0.5 to 0.9.

13. The fuel injector as recited by claim 1, wherein an opening movement of the nozzle needle is restricted by contact of the second end of the nozzle needle with a nozzle proximal end of the throttle plate.

14. The fuel injector as recited by claim 13, wherein the second end of the nozzle needle contacts a lowermost portion of the throttle plate when the second end of the nozzle needle contacts the nozzle proximal end of the throttle plate.

15. The fuel injector as recited by claim 1, wherein the throttle plate is guided peripherally on a wall of the control chamber, and the throttle plate rests peripherally against the wall of the control chamber in a sliding manner so as to seal, and wherein the throttle plate has an H shaped cross section.

16. A fuel injection device comprising:

at least one fuel injector, including:

a control chamber in fluid communication with a pilot valve, such that the pilot valve is configured to selectively relieve pressure of the control chamber in order to control a nozzle needle stroke of an axially displaceable nozzle needle of the injector; and at least one nozzle on a first end of the nozzle needle and wherein the fuel injector has the control chamber on a second end of the nozzle needle;

wherein the control chamber is subdivided by a throttle plate, accommodated therein, into a first chamber, and a second chamber which is closer to the nozzle than the first chamber, said chambers communicating with each other via the throttle plate, wherein the throttle plate is guided peripherally on a wall of the control chamber, and the throttle plate rests peripherally against the wall of the control chamber in a sliding manner so as to seal, and wherein the throttle plate has an H shaped cross section;

wherein a first resilient element and a second resilient element are each accommodated in a pre-stressed manner against the throttle plate in the first chamber and in the second chamber, respectively, said first and second resilient elements bear in an axially displaceable manner upon the throttle plate such that the throttle plate is axially displaceable within the control chamber; and wherein a high pressure inflow line into the control chamber and a relief outflow line out of the control chamber lead into and out of the first chamber respectively.

17. A fuel injector, comprising:

a control chamber in fluid communication with a pilot valve, such that the pilot valve is configured to selectively relieve pressure of the control chamber in order to control a nozzle needle stroke of an axially displaceable nozzle needle of the injector; and at least one nozzle on a first end of the nozzle needle and wherein the fuel injector has the control chamber on a second end of the nozzle needle;

wherein the control chamber is subdivided by a throttle plate, accommodated therein, into a first chamber, and a second chamber which is closer to the nozzle than the first chamber, said chambers communicating with each other via the throttle plate, wherein the throttle plate is guided peripherally on a wall of the control chamber, and the throttle plate rests peripherally against the wall of the control chamber in a sliding manner, and wherein the throttle plate has a first portion extending upwardly from a crossbar and cylindrically defining at least in part the first chamber, the throttle plate having a second portion extending downwardly from the crossbar and cylindrically defining at least in part the second chamber;

wherein a first resilient element and a second resilient element are each accommodated in a pre-stressed manner against the throttle plate in the first chamber and in the second chamber, respectively, said first and second resilient elements bear in an axially displaceable manner upon the throttle plate; and wherein a high pressure inflow line into the control chamber and a relief outflow line out of the control chamber lead into and out of the first chamber respectively.

18. The fuel injector as recited by claim 17, wherein the throttle plate has an H shaped cross section.

19. The fuel injector as recited by claim 17, wherein the throttle plate is axially displaceable within the control chamber.

* * * * *